US010499685B2

(12) United States Patent
Prestia et al.

(10) Patent No.: US 10,499,685 B2
(45) Date of Patent: Dec. 10, 2019

(54) METHOD FOR MANUFACTURING INDUCTIVELY HEATABLE TOBACCO RODS

(71) Applicant: PHILIP MORRIS PRODUCTS S.A., Neuchatel (CH)

(72) Inventors: Ivan Prestia, Longara di Calderara di Reno (IT); Daniele Sanna, Marin-Epagnier (CH); Christian Agostini, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 135 days.

(21) Appl. No.: 15/569,217

(22) PCT Filed: May 19, 2016

(86) PCT No.: PCT/EP2016/061170

§ 371 (c)(1),
(2) Date: Oct. 25, 2017

(87) PCT Pub. No.: WO2016/184929

PCT Pub. Date: Nov. 24, 2016

(65) Prior Publication Data

US 2018/0352851 A1 Dec. 13, 2018

(30) Foreign Application Priority Data

May 21, 2015 (EP) ..... 15168555

(51) Int. Cl.
*A24F 47/00* (2006.01)
*A24D 1/14* (2006.01)
(Continued)

(52) U.S. Cl.
CPC ..... *A24D 1/14* (2013.01); *A24B 3/14* (2013.01); *A24D 1/002* (2013.01); *A24F 47/008* (2013.01)

(58) Field of Classification Search
CPC ..... A24B 3/14; A24C 5/1821
See application file for complete search history.

(56) References Cited

U.S. PATENT DOCUMENTS

2009/0145449 A1 6/2009 Cieslikowski

FOREIGN PATENT DOCUMENTS

CN 1056228 11/1991
CN 1126426 7/1996
(Continued)

OTHER PUBLICATIONS

PCT/EP2016/061170 International Search Report and Written Opinion dated Aug. 11, 2016 (9 pages).
(Continued)

*Primary Examiner* — Eric Yaary
(74) *Attorney, Agent, or Firm* — Mueting, Raasch & Gebhardt, P.A.

(57) ABSTRACT

The method for manufacturing inductively heatable tobacco rods comprises the steps of providing a continuous profile of a susceptor and cutting the continuous profile of susceptor into individual susceptor segments. The method further comprises the steps of guiding an aerosol-forming tobacco substrate along a tobacco substrate converging device, positioning the individual susceptor segments in the aerosol-forming tobacco substrate and converging the aerosol-forming tobacco substrate to a final rod shape. Therein, the step of positioning the individual susceptor segments in the aerosol-forming tobacco substrate is performed before performing the step of converging the aerosol-forming tobacco substrate to its final rod shape.

12 Claims, 2 Drawing Sheets

(51) Int. Cl.
*A24B 3/14* (2006.01)
*A24D 1/00* (2006.01)

(56) References Cited

FOREIGN PATENT DOCUMENTS

| | | |
|---|---|---|
| CN | 101862038 | 10/2010 |
| WO | WO 95/27411 | 10/1995 |
| WO | WO 2013/178768 | 12/2013 |
| WO | WO 2014/048745 | 4/2014 |

OTHER PUBLICATIONS

Office Action issued in China for Application No. 201680022531.8 dated Sep. 30, 2019 (6 pages).

METHOD FOR MANUFACTURING INDUCTIVELY HEATABLE TOBACCO RODS

This application is a U.S. National Stage Application of International Application No. PCT/EP2016/061170, filed May 19, 2016, which was published in English on Nov. 24, 2016, as International Publication No. WO 2016/184929 A1. International Application No. PCT/EP2016/061170 claims priority to European Application No. 15168555.9 filed May 21, 2015.

The present invention relates to a method for manufacturing inductively heatable tobacco rods for use in inductive heating devices.

From the prior art aerosol-delivery systems are known, which comprise an aerosol-forming substrate and an inductive heating device. The inductive heating device comprises an induction source which produces an alternating electromagnetic field which induces heat generating eddy currents and hysteresis losses in a susceptor. The susceptor is in thermal proximity of the aerosol-forming substrate, for example a tobacco substrate. The heated susceptor in turn heats the aerosol-forming substrate which comprises a material which is capable of releasing volatile compounds that can form an aerosol.

It would be desirable to have an efficient method for manufacturing inductively heatable aerosol-forming tobacco rods suitable for use in inductive heating devices.

According to an aspect of the present invention, there is provided a method for manufacturing inductively heatable tobacco rods. The method comprises the steps of providing a continuous profile of a susceptor and cutting the continuous profile of susceptor into individual susceptor segments. The method further comprises the steps of guiding an aerosol-forming tobacco substrate along a tobacco substrate converging device, positioning the individual susceptor segments in the aerosol-forming tobacco substrate and converging the aerosol-forming tobacco substrate to a final rod shape. Therein, the step of positioning the individual susceptor segments in the aerosol-forming tobacco substrate is performed before performing the step of converging the aerosol-forming tobacco substrate to its final rod shape.

The continuous provision of individual segment into a continuous material for the manufacture of an inductively heatable tobacco rod is a very efficient manner for mass production of inductively heatable tobacco segments. In addition, the manufacture of tobacco rods provides flexibility in the dimensioning of the tobacco segments or of inductively heatable tobacco plugs, respectively, as the final tobacco segments are typically named. Variations, for example but not limited to: susceptor profile form, type of susceptor, length of susceptor, location of susceptor in the tobacco substrate, type of tobacco substrate or length and lateral dimension of tobacco rod, are achievable. Preferably, such variations may be achieved without or with only limited adaption of the manufacturing process of conventional tobacco rods, that is, tobacco rods used for the manufacture of tobacco plugs for heating devices comprising conventional resistance heating elements such as for example heating blades.

The individual susceptor segments are positioned in the tobacco substrate, while the tobacco substrate has been partially converged but has not yet achieved the final rod shape. The partially converged tobacco substrate may be a loose arrangement of gathered tobacco substrate, basically of any form or shape, or may already have a rod shape, however with a lower density (or larger diameter) than in the final rod shape. By positioning the susceptor segments in the partially converged tobacco substrate, the introduction of the susceptor segments in the tobacco substrate is facilitated. In addition, due to the already (partially) converged tobacco material, the final position of the susceptor segments in the tobacco rod is already well defined.

As used herein, the term 'susceptor' refers to a material that is capable to convert electromagnetic energy into heat. When located in an alternating electromagnetic field, eddy currents are induced and hysteresis losses occur in the susceptor causing heating of the susceptor. As the susceptor is located in thermal contact or close thermal proximity with the aerosol-forming tobacco substrate, the aerosol-forming tobacco substrate is heated by the susceptor such that an aerosol is formed. Preferably, the susceptor is arranged in direct physical contact with the aerosol-forming tobacco substrate, for example within the aerosol-forming tobacco substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may be a multi-material susceptor and may comprise a first susceptor material and a second susceptor material. The first susceptor material is disposed in intimate physical contact with the second susceptor material. The second susceptor material preferably has a Curie temperature that is lower than 500° C. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate and the temperature control of the heating may be separated. The first susceptor material is preferably a magnetic material having a Curie temperature that is above 500° C. It is desirable from the point of view of heating efficiency that the Curie temperature of the first susceptor material is above any maximum temperature that the susceptor should be capable of being heated to. The second Curie temperature may preferably be selected to be lower than 400° C., preferably lower than 380° C., or lower than 360° C. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-forming substrate. The second Curie temperature may, for example, be within the range of 200° C. to 400° C., or between 250° C. and 360° C. The second Curie temperature of the second susceptor material may, for example, be selected such that, upon being heated by a susceptor that is at a temperature equal to the second Curie temperature, an overall average temperature of the aerosol-forming substrate does not exceed 240° C.

Preferably, the continuous profile of susceptor is a filament, rod, sheet or band. If the susceptor profile is of constant cross-section, for example a circular cross-section, it has a preferable width or diameter of between about 1 millimeter and about 5 millimeter. If the susceptor profile has the form of a sheet or band, the sheet or band preferably has a rectangular shape having a width preferably between about 2 millimeter and about 8 millimeter, more preferably, between about 3 millimeter and about 5 millimeter, for example 4 millimeter and a thickness preferably between about 0.03 millimeter and about 0.15 millimeter, more preferably between about 0.05 millimeter and about 0.09 millimeter, for example 0.07 millimeter.

Preferably, the aerosol-forming tobacco substrate contains volatile tobacco flavour compounds, which are released from the tobacco substrate upon heating. The aerosol-forming tobacco substrate may comprise or consist of blended tobacco cut filler or may comprise homogenised tobacco material. Homogenised tobacco material may be formed by agglomerating particulate tobacco. The aerosol-forming substrate may additionally comprise a non-tobacco-containing material, for example homogenised plant-based material other than tobacco.

Preferably, the aerosol-forming tobacco substrate is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap, where the casting gap typically defines the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry forming the cast leaf or used in other aerosol-forming tobacco substrates may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. The aerosol-former may be any suitable known compound or mixture of compounds that, in use, facilitates formation of a dense and stable aerosol and that is substantially resistant to thermal degradation at the operating temperature of an inductive heating device the inductively heatable tobacco substrate shall be used with. An aerosol former may be chosen based on its ability, for example, to remain stable at or around room temperature but able to volatize at a higher temperature, for example, between 40 degree Celsius and 450 degree Celsius.

The aerosol former may also have humectant type properties that help maintain a desirable level of moisture in an aerosol-forming substrate when the substrate is composed of a tobacco-based product, particularly including tobacco particles. In particular, some aerosol formers are hygroscopic material that functions as a humectant, that is, a material that helps keep a tobacco substrate containing the humectant moist.

One or more aerosol former may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

The aerosol-forming tobacco substrate may comprise other additives and ingredients, such as flavourants. The aerosol-forming tobacco substrate preferably comprises nicotine and at least one aerosol-former. The susceptor being in thermal proximity of or in thermal or physical contact with the aerosol-forming tobacco substrate allows for a more efficient heating and thus, higher operating temperatures may be reached. The higher operating temperature enables glycerin to be used as an aerosol-former which provides an improved aerosol as compared to the aerosol-formers used in the known systems.

A crimped tobacco sheet, for example a cast leaf, may have a thickness in a range of between about 0.5 millimeter and about 2 millimeter, preferably between about 0.8 millimeter and about 1.5 millimeter, for example 1 millimeter. Deviations in thickness of up to about 30 percent may occur due to manufacturing tolerances.

Preferably, the inductively heatable tobacco rod has a circular or oval cross-section. However, the tobacco rod may also have the cross-section of a rectangle or of a polygon.

The step of positioning the individual susceptor segments in the aerosol-forming tobacco substrate may comprise positioning the individual susceptor segments in a central portion of the tobacco substrate. This may be favorable in view of heat distribution in the tobacco substrate, for example for a homogeneous or symmetric heat distribution in the tobacco rod. Heat generated in the central portion may dissipate in radial direction and heat-up tobacco substrate around an entire circumference of the susceptor. Depending on the position and arrangement of the individual segments in the tobacco substrate, for example distance from each other, heat may dissipated into tobacco substrate around the entire susceptor segment.

Preferably, a central portion of the tobacco substrate is a region of the tobacco rod encompassing a central axis of the tobacco rod. The susceptor segments are arranged substantially longitudinally within the tobacco rod. This means that a length dimension of the susceptor segments is arranged to be approximately parallel to a longitudinal direction of the tobacco rod, for example within plus or minus 10 degrees of parallel to the longitudinal direction of the tobacco rod. Preferably, the susceptor segments may be positioned in a radially central position within the tobacco rod, and extend along the longitudinal axis of the tobacco rod. Preferably, the individual susceptor segments are arranged distanced from each other along a longitudinal axis of the tobacco rod.

According to another aspect of the method according to the invention, the method further comprises the step of providing the tobacco substrate with a longitudinally running folding structure. The step of positioning the continuous profile of susceptor in the tobacco substrate then comprises arranging the continuous profile of susceptor material parallel to and in between the longitudinally running folding structure of the tobacco substrate. This may facilitate the insertion and positioning of the susceptor in the tobacco material.

The tobacco substrate may be provided with a folding structure to facilitate the folding of the substrate to its final rod shape. Such a folding structure may support a regular folding and thus the manufacture of tobacco plugs with reproducible specifications. The continuous profile of susceptor may now be arranged in between folds, preferably between two neighbouring folds, of the folding structure. By this, the continuous profile of susceptor may be inserted in the partially gathered tobacco substrate keeping a folded structure or regularity of such a folded structure of the folded tobacco substrate. Preferably, the tobacco substrate is provided in the form of a sheet and is gathered or folded into a rod shape. Preferably, the longitudinally running folding structure provides the tobacco substrate with a wave-like cross section.

According to a further aspect of the method according to the invention, the step of cutting the continuous profile of susceptor into individual susceptor segments is performed while guiding the continuous profile of susceptor along a surface of a cutting support. By this, the cutting and transport of the susceptor or susceptor segments is combined. In addition, via the cutting support the individual segments may be prepared for the introduction into the tobacco substrate. Preferably, the cutting support is a cutting wheel and the surface of the cutting support is a circumference of the cutting wheel. Preferably, the cutting of the susceptor is performed by impacting a cutting blade against the continuous profile of susceptor, while the continuous profile of susceptor is guided along the surface of the cutting support. This allows for a fast and precise cutting of also different types of susceptor. In addition, a length of a susceptor segment may be defined and varied by a repetition rate of the impacting cutting blades or by a transport speed of the continuous profile of susceptor along the cutting support or by a combination of repetition rate of cutting means and transport speed of susceptor.

The individual susceptor segments may be transported by the cutting support to the tobacco substrate and positioned therein directly through the cutting support. However, preferably, the method according to the invention further comprises the step of transferring the individual susceptor segments from the cutting support to an insertion device. Preferably, the insertion device is an insertion wheel. The insertion device may support a guiding and the exact positioning of the individual susceptor segments in the tobacco substrate. For example, the susceptor segments may be aligned with and in the tobacco substrate by the insertion device. The susceptor segments may be guided for example along a recess in the insertion device, for example, on the circumference of an insertion wheel, or, for example, in a slit or channel formed in the insertion device, for example in and along the circumference of an insertion wheel. Preferably, while transferring the individual segments from the cutting support onto an insertion device, the segments may be separated. That is, the segments may be arranged on the insertion device including a distance to each other. By synchronizing the insertion device and the tobacco substrate, such a distance on the insertion wheel may correspond to or define the distance of the individual susceptor segments in the final inductively heatable tobacco rod. A transfer from a cutting support to an insertion device may include one or several transfer steps, for example over several wheels or drums. Some of these drums may serve as turning elements for the susceptor band or the susceptor segments, respectively. By this, an arrangement of a bobbin of susceptor material and a cutting may be independent from a position of the cut susceptor segment upon insertion. For example, a continuous susceptor band may be arranged to lie flat against a circumference of a cut wheel for cutting the susceptor. However, it may be preferred that for insertion, the susceptor segment is turned to be inserted into the tobacco substrate with its small side up.

According to another aspect of the method according to the invention, the method further comprises the step of forming a channel in partially converged tobacco substrate and positioning the individual susceptor segments in the channel. The channel may define the position of the susceptor segments with respect to their localization and insertion depth in the tobacco substrate and in the tobacco rod after entirely converging the tobacco substrate to its final rod shape. A channel facilitates the insertion of the susceptor segments in the tobacco substrate and may guarantee the positioning of the susceptor segments without damaging, deforming or displacement of the susceptor segments.

Preferably, the channel in the partially converged tobacco substrate is formed by the insertion device, for example by extending the insertion device or a circumferential portion of the insertion device into the partially converged tobacco substrate. By this, the position of the susceptor in the tobacco substrate is given by the position of the insertion device. Such a position may be supported in view of a lateral position as well as a depth in the tobacco rod.

The insertion device may comprise a wedge-shaped portion for insertion into the partially converged tobacco substrate. For example, an insertion wheel may have a wedge-shaped circumference. The insertion device or the wedge-shaped portion thereof, respectively, displaces the tobacco substrate, preferably sideways, such that the individual susceptor segments may be positioned in the channel formed by the insertion device.

Preferably, the continuous profile of susceptor is a continuous sheet of susceptor. Thus the susceptor segments cut from the continuous sheet are strips. Preferably, the continuous sheet of susceptor is provided on a bobbin. Preferably, a width of the sheet of susceptor is the width of the susceptor in a final product. A profile of susceptor in the form of a sheet allows to provide heat in a tobacco rod, which heat may originate over the diameter of the rod and along the length of the rod. By this, a heat distribution in the tobacco rod similar to the conventionally heated heating devices comprising heating blades may be achieved, however, requiring less power and providing all advantages of contactless heating (for example, no broken blades, no residues on heating element, separated electronics or facilitated cleaning of the device).

According to another aspect of the method according to the invention, the method further comprises the step of wrapping the inductively heatable tobacco rod in a wrapper material. The wrapper material wrapped around the tobacco rod may help to stabilize the shape of the aerosol-forming tobacco substrate. It may also help to prevent an inadvertent disassociation of the tobacco substrate and the susceptor.

In general, the so manufactured inductively heatable tobacco rod is cut into inductively heatable tobacco segments. Preferably, the cut tobacco segments are of equal length. Depending on the consumable or inductively heatable smoking article to be manufactured using an inductively heatable tobacco segment, a length of the segments may be varied.

Preferably, the inductively heatable tobacco rod is cut at positions between subsequent susceptor segments in the tobacco rod. This is preferably done by synchronizing the cutting of the tobacco rod with a moving speed of the tobacco rod. If the susceptor segments are arranged in the tobacco rod not directly adjacent each other but at a distance to each other, then preferably, the rod is cut midway between two subsequent susceptor segments. Thus, no susceptor material is cut and preferably each susceptor segment is enveloped by a same amount of tobacco substrate. High reproducibility in the manufacturing of tobacco segment may be achieved.

According to another aspect of the invention, there is provided an inductively heatable smoking article for use in an inductive heating device. The inductively heatable smoking article comprises an inductively heatable tobacco segment. The inductively heatable tobacco segment is a portion of an inductively heatable tobacco rod, which inductively heatable tobacco rod has been manufactured according to the method as described in this application. The inductively heatable tobacco segment comprises aerosol-forming tobacco substrate and a susceptor segment.

In general, an inductively heatable smoking article is introduced into a cavity of the inductive heating device such that heat may be induced in the susceptor segment of the tobacco segment by a corresponding inductor of a power supply electronics arranged in the inductive heating device.

An inductively heatable tobacco segment or (final-length) tobacco plug achieves its desired length by cutting the inductively heatable tobacco rod. Such a tobacco segment may have a segment length in a range between about 2 millimeter and about 20 millimeter, more preferably between about 6 millimeter and about 15 millimeter, for example between about 8 millimeter and about 12 millimeter such as 10 millimeter or 12 millimeter.

The length of a susceptor segment may be defined by operation of the cutting means. The susceptor segment has at a maximum a same length as the tobacco plug. Preferably, the susceptor segment is shorter than the tobacco plug. By this, the susceptor segment may entirely be enveloped by tobacco substrate. In addition, a positioning of the susceptor segment relative to the length of a final tobacco plug may provide more tolerance due to a lowered risk of an overlapping two susceptor segments.

The susceptor segment preferably has a length of between about 2 millimeter and about 20 millimeter, more preferably between about 6 millimeter to about 15 millimeter, for example between about 8 millimeter and about 12 millimeter such as 10 millimeter or 12 millimeter.

Whenever the term 'about' is used in connection with a particular value throughout this application this is to be understood such that the value following the term 'about' does not have to be exactly the particular value due to technical considerations. However, the term 'about' is understood as explicitly including and disclosing the respective boundary value.

Preferably, the susceptor segment has a length dimension that is greater than its width dimension or its thickness dimension, for example greater than twice its width dimension or its thickness dimension.

The tobacco segment or tobacco plug, respectively, may be attached to a mouthpiece, which optionally may comprise a filter plug and to further segment, for example aerosol-cooling or spacer segments. The inductively heatable aerosol-forming tobacco plug and the mouthpiece and possibly the additional segments may be assembled to form a structural entity. Every time a new inductively heatable tobacco plug is to be used in combination with an inductive heating device, the user is automatically provided with a new mouthpiece, which might be appreciated from a hygienic point of view. Optionally the mouthpiece may be provided with a filter plug, which may be selected in accordance with the composition of the tobacco plug.

Advantages and further aspect of the smoking article have been discussed relating to the method according to the invention and will not be repeated.

The invention is further described with regard to embodiments, which are illustrated by means of the following drawings, wherein:

FIG. 1 schematically illustrates the method according to the invention;

Figure 1:
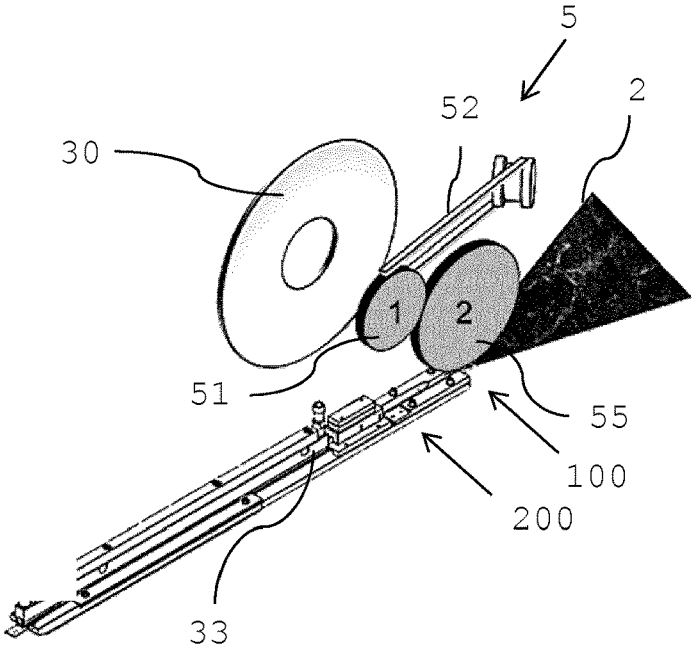

In FIG. 1 a continuous tobacco sheet 2 is guided along a converging device, where the tobacco sheet 2 is gathered from an essentially flat shape to a rod shape. The tobacco sheet 2, for example a cast leaf, may be crimped already or being crimped in-line before being gathered.

A continuous band 1 of a susceptor material, for example a ferromagnetic stainless steel band, is provided on a bobbin 30. The continuous band 1 is unwound from the bobbin 30 and passes a cutting and separating apparatus 5 before being inserted into the tobacco sheet 2. The cutting and separating apparatus 5 comprises a cut wheel 51, a cutting device 52 and a feeding wheel 55. In this simplified variant only two wheels are shown. However, as explained above, more wheels or turning mechanisms for the susceptor or the susceptor segments may be provided for a desired position of the susceptor segment upon insertion in the tobacco sheet 2

The unwound continuous band 1 of susceptor material is guided along the circumference of the cut wheel 51. The cutting device 52 is arranged next to the cut wheel 51 to cut the continuous band on the cut wheel 51 into individual susceptor segments 10. The cutting device 52 is provided with cutting edges movable to impact onto the susceptor material arranged on the circumference of the cut wheel 51. Thereby, the band 1 of susceptor material is cut into susceptor segments 10 in the form of individual strips. To support the cutting, circumference of cut wheel 51 and cutting edges of cutting device 52 may have corresponding shapes. Preferably, the circumference of the cut wheel is plane such that the susceptor band 1 may securely rest against and be guided on this circumference.

The individual susceptor segments 10 are transferred from the cut wheel 51 to the feeding wheel 55, for example, into a circumferentially running slit 551 of the feeding wheel 55.

The diameter of the feeding wheel 55 is larger than the diameter of the cut wheel 51. Thus, upon transferring the individual susceptor segments, the segments are separated and arranged distanced of each other along the circumference of the feeding wheel 55. Upon selection of the ratio of the diameters of the two wheels 51,52 and the ratios of their rotational speed, a distance between individual segments 10 on the feeding wheel 55 and in the final tobacco rod may be selected and defined.

In the embodiment of FIG. 1, bobbin 30, cut wheel 51 and feeding wheel 55 are arranged in a same plane. The feeding wheel 55 is arranged to extend with a circumferential portion 550 into a groove 330 in a final rod formation and transport line 33. The partially but not entirely gathered tobacco sheet 201 is guided in and along this groove 330. While being guided in the groove 330, the partially gathered tobacco sheet 201 is provided with the susceptor segments 10, is then formed to a final rod shape and is wrapped in a wrapper material 202.

Figure 2:
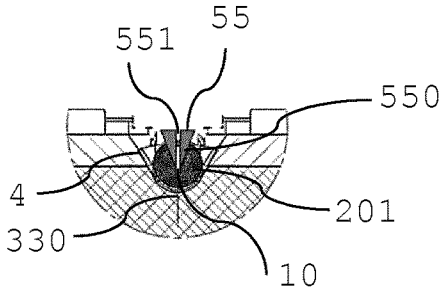
FIGS. 2, 3 show cross-sections through a manufacturing line at different positions.

As can be seen in FIG. 2, at position 100 the circumferential portion 550 of the feeding wheel 55 acts as inserter for the susceptor segments 10. The circumferential portion forms a channel in the partially gathered tobacco sheet 201, while the susceptor segments 10 are continuously positioned in the partially gathered tobacco sheet 201. A circumferential speed of the feeding wheel 55 corresponds to the transport speed of the tobacco sheet 2 in the groove 330 at the insertion position 100 arranged in an upstream region of the transport line 33. By this, no speed difference between the feeding wheel and the tobacco sheet exists at the insertion position. This secures a precise insertion of the susceptor segments 10.

To support insertion, the circumferential portion 550 of the feeding wheel 55 is wedge-shaped for smooth insertion into the sheet material 2. The feeding wheel 55 forms a channel in the partially gathered tobacco sheet 201 for insertion of the susceptor segments 10. The circumferential portion 550 of the feeding wheel 55 is split in a direction perpendicular (vertical) to the transport direction (horizontal) of the tobacco sheet forming a slit 551 in the inserted circumferential portion 550. The slit 551 serves as guiding and positioning means for the susceptor segments 10 in the tobacco sheet. Preferably, a length of the slit 551 limits a movement of the susceptor segments 10 in a direction away from the gathered tobacco sheet 201. Thus, the insertion depth of the feeding wheel 55 in the gathered tobacco sheet 201, or in the groove, respectively, possibly in combination with the length of the slit 551 may define the insertion depth of the susceptor segments 10 in the final tobacco rod.

Suction may be applied through the slit 551 or channel for making the susceptor segments remain in the feeding wheel 55. At the insertion position 100, suction may be interrupted such that the susceptor segments 10 may be positioned in the partially gathered tobacco sheet 201. Insertion may also be supported by a short overpressure applied to the suction channel 551.

Figure 3:
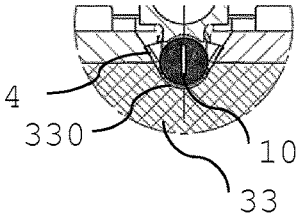

A continuous wrapper material 202, for example a paper sheet or foil, is provided from below the tobacco sheet 2. The wrapper material 202 is inserted into the groove 330 of the transportation line 33 such that the partially gathered tobacco sheet 201 comes to lie on the wrapper material 202 in the transportation line 33. After susceptor segment insertion at position 200, which is shown in more detail in FIG. 3, the tobacco sheet is formed to its final rod shape and the susceptor segment 10 is entirely enveloped by the tobacco substrate. In the following, the wrapper material 202 is wrapped entirely around the susceptor containing tobacco sheet forming the final inductively heatable tobacco rod.

The tobacco rod is cut between the susceptor segments into tobacco plugs 20 of a length, which is predefined by the length of the susceptor segments. Preferably, segment insertion and positioning is synchronized with cutting means for cutting the tobacco rod, such that the rod may be cut exactly midway between two susceptor segments.

Figure 4:
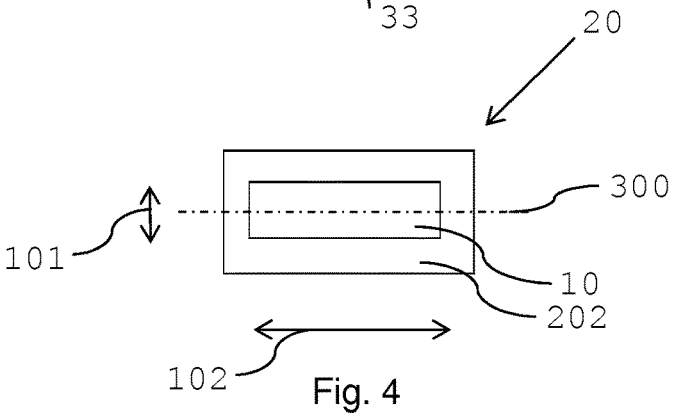
FIG. 4 shows a view onto a longitudinal cross section of an inductively heatable tobacco segment.

FIG. 4 shows a view onto a longitudinal cross section through an inductively heatable tobacco plug 20 manufactured with the method according to the invention. The susceptor segment 10 is arranged along a longitudinal axis 300 of the tobacco plug and has a length 102, which is shorter than the length of the tobacco plug 20. Preferably, the susceptor segment is arranged symmetrically in the tobacco plug 20 with respect to the length of the tobacco plug as well as with respect to the cross section of the tobacco plug. The width 101 of the segment 10 is smaller than the diameter of the tobacco plug 20. In the inductively heatable tobacco plug, the susceptor segment 10 is entirely surrounded by tobacco substrate. The tobacco substrate comprises a gathered sheet of crimped homogenized tobacco material. The crimped sheet of homogenized tobacco material preferably comprises glycerine as an aerosol-former.

The length 102 of the tobacco plug may, for example, be 12 millimeter, while the length of the susceptor strip 10 may be 10 millimeter. The width 101 of the susceptor strip may, for example, be 4 millimeter with a diameter of the tobacco plug of 8 mm.

Figure 5:
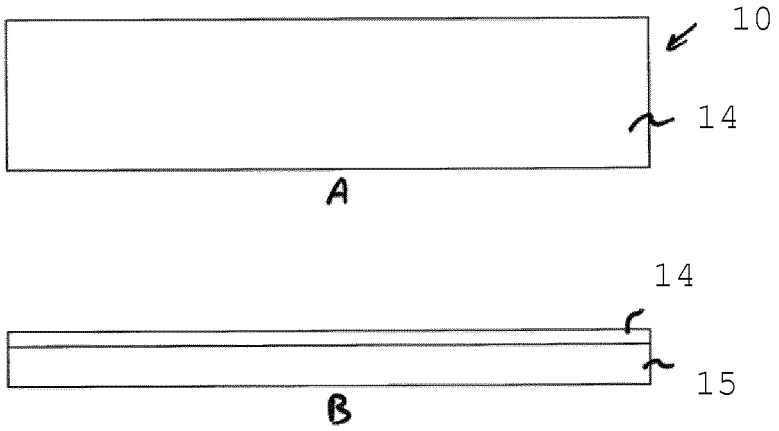
FIG. 5A is a plan view of a susceptor segment for use in a tobacco product.
FIG. 5B is a side view of the susceptor segment of FIG. 5A.

FIG. 5A and FIG. 5B illustrate an example of a unitary multi-material susceptor segment 10 for use in a tobacco product according to an embodiment of the invention. The susceptor segment 10 is in the form of an elongate strip having a length of 12 mm and a width of 4 mm. The susceptor segment is formed from a first susceptor material 15 that is intimately coupled to a second susceptor material 14. The first susceptor material 15 is in the form of a strip of grade 430 stainless steel having dimensions of 12 mm by 4 mm by 25 micrometres. The second susceptor material 14 is in the form of a strip of nickel having dimensions of 12 mm by 4 mm by 10 micrometres. The susceptor segment is formed by cladding the strip of nickel 14 to the strip of stainless steel 15. The total thickness of the susceptor segment is 35 micrometres. The susceptor segment 10 of FIG. 5 may be termed a bi-layer or multilayer susceptor segment.

The invention claimed is:

1. Method for manufacturing inductively heatable tobacco rods, the method comprising the steps of:

providing a continuous profile of a susceptor;

cutting the continuous profile of susceptor into individual susceptor segments;

guiding an aerosol-forming tobacco substrate along a tobacco substrate converging device;

positioning the individual susceptor segments in the aerosol-forming tobacco substrate;

converging the aerosol-forming tobacco substrate to a final rod shape, wherein the step of positioning the individual susceptor segments in the aerosol-forming tobacco substrate is performed before performing the step of converging the aerosol-forming tobacco substrate to its final rod shape.

2. Method according to claim 1, wherein the step of positioning the individual susceptor segments in the aerosol-forming tobacco substrate comprises positioning the individual susceptor segments in a central portion of the tobacco substrate.

3. Method according to claim 1, wherein the method further comprises the step of providing the tobacco substrate with a longitudinally running folding structure, and wherein the step of positioning the individual susceptor segments in the tobacco substrate comprises arranging the individual susceptor segments parallel to and in between the longitudinally running folding structure of the tobacco substrate.

4. Method according to claim 1, wherein the step of cutting of the continuous profile of susceptor into individual susceptor segments is performed while guiding the continuous profile of susceptor along a surface of a cutting support.

5. Method according to claim 4, wherein the step of cutting the continuous profile of susceptor into individual susceptor segments is performed by impacting a cutting blade against the continuous profile of susceptor while the continuous profile of susceptor is guided along the surface of the cutting support.

6. Method according to claim 4, further comprising the step of transferring the individual susceptor segments from the cutting support to an insertion device.

7. Method according to claim 6, further comprising the step of separating the individual susceptor segments while preforming the step of transferring the individual susceptor segments from the cutting support to the insertion device.

8. Method according to claim 1, further comprising the step of forming a channel in partially converged aerosol-forming tobacco substrate and positioning the individual susceptor segments in the channel.

9. Method according to claim 1, wherein the step of providing a continuous profile of a susceptor comprises providing a continuous sheet of susceptor.

10. Method according to claim 1, further comprising the step of wrapping the inductively heatable tobacco rod in a wrapper material.

11. Method according to claim 1, further comprising the step of cutting the inductively heatable tobacco rod at positions between subsequent susceptor segments in the tobacco rod.

12. Method according to claim 11, therein cutting the inductively heatable tobacco rod into inductively heatable tobacco segments of equal length.

* * * * *